US005577636A

United States Patent [19]

Fukuoka et al.

[11] Patent Number: 5,577,636

[45] Date of Patent: Nov. 26, 1996

[54] MULTI-TUBE CONTAINER HAVING BREAKABLE CONNECTIONS AT BOTH ENDS THEREOF

[75] Inventors: Hiroki Fukuoka; Kenzo Teshima; Yoshiharu Hatakeyama, all of Tokyo, Japan

[73] Assignee: Yoshida Kogyo Co., Ltd., Tokyo, Japan

[21] Appl. No.: 448,182

[22] Filed: May 23, 1995

[30] Foreign Application Priority Data

Jun. 10, 1994 [JP] Japan ..... 6-128705

[51] Int. Cl.[6] ..... B65D 47/10

[52] U.S. Cl. ..... 222/94; 222/107; 222/129; 222/541.9

[58] Field of Search ..... 222/94, 107, 215, 222/541.5–541.9, 129; 206/484

[56] References Cited

U.S. PATENT DOCUMENTS

| | | | |
|---|---|---|---|
| D. 309,097 | 7/1990 | Price | D9/341 |
| 2,663,461 | 12/1953 | Brown | 222/107 |
| 3,128,920 | 4/1964 | Volckening et al. | 222/215 |
| 3,162,339 | 12/1964 | Lecluyse | 222/541.9 |
| 3,204,835 | 9/1965 | Michel | 222/541.5 |
| 3,366,289 | 1/1968 | Badavas et al. | 222/541.5 |
| 3,460,724 | 8/1969 | Chmela | 222/541.5 |
| 3,858,739 | 1/1975 | Turner et al. | 222/541.5 X |
| 3,917,120 | 11/1975 | Larenz et al. | 222/541.9 X |
| 4,413,753 | 11/1983 | Stock | 222/541.5 X |
| 4,469,254 | 9/1984 | Hansen | 222/541.6 X |
| 4,502,616 | 3/1985 | Meierhoefer | 222/541.6 X |
| 4,512,475 | 4/1985 | Federighi | 222/541.6 X |
| 4,785,951 | 11/1988 | Bennett | 222/541.5 X |
| 4,917,267 | 4/1990 | Laverdure | 222/541.5 X |
| 4,921,137 | 5/1990 | Heijenga | 222/541.6 X |
| 5,076,474 | 12/1991 | Hansen | 222/541.5 X |

FOREIGN PATENT DOCUMENTS

| | | |
|---|---|---|
| 61-30622 | 2/1986 | Japan . |
| 63-594 | 1/1988 | Japan . |

*Primary Examiner*—Kevin P. Shaver

[57] ABSTRACT

This invention relates to a multi-tube container having multiple tubes in parallel. The container includes a plurality of body portions, each of which having a hollow portion for containing contents, a plurality of twistable head portions formed at one end of each of the body portions, a plurality of neck portions, each of which can be broken off by twisting of the head portion, creating an opening for extruding the contents from the hollow portion and is located between the body portion and the head portion, and a plurality of sealing portions formed at the other end of each of said body portions. Each of the sealing portions are breakably connected to the adjacent sealing portions, and at least one of the head portions and the neck portions are breakably connected to each other.

11 Claims, 9 Drawing Sheets

MULTI-TUBE CONTAINER HAVING BREAKABLE CONNECTIONS AT BOTH ENDS THEREOF

BACKGROUND OF THE INVENTION

1. Field of the Invention

This invention relates to a multi-tube container in which multiple squeezable tubes made of a plastic material are arranged in parallel and made separable from one another and to a manufacturing method for the multi-tube container.

2. Description of Related Art

Items that are free from harmful substances, such as corrosion inhibitors, contained in containers fir foods, cosmetics, and etc. are getting popular these days, and consumers are more oriented toward natural tastes or natural features. Therefore, there are demands for subdivided containers with contents which can be used up in one time or in a couple of times after the containers have been opened.

Some technologies, such as disclosed in Japanese Utility Model Unexamined Publication No. 61-30,622 and Japanese Utility Model Publication No. 63-594, have been developed so far in order to accomplish the object above. The former technology relates to a multi-container type package in which plural containers with respective caps are arranged in parallel and in which adjacent containers are detachably connected with each other at their caps and bodies by means of connecting pieces. The latter technology relates to a multi-tube container in which multiple squeezable tubes with respective caps are arranged in parallel and in which respective connection strings connect one tube with the adjacent tube at their caps and bodies.

The former multi-container type package, however, raises a problem that it cannot be molded easily because it requires to provide connecting pieces at respective caps and bodies, and to connect those connecting pieces breakably. The package further raises a problem that for respective containers are connected simply at the caps and bodies the package may not stably maintain its connection because the lower portions, or the bottoms, to which weights of the filled contents are exerted, of the container are not connected. The latter multi-tube container requires to connect the containers with each other by attaching thick connecting strings between the caps and between the bodies, so that the container cannot be molded easily. The container also raises a problem that the connecting strings cannot be cut easily when the respective containers are to be separated. As well as the above, the container further raises a problem that the container may not stably maintain its connection because the bottoms, to which weights of the filled contents are exerted, of the container are not connected.

SUMMARY OF THE INVENTION

It is an object of the invention to provide a novel container to accommodate with the needs described above, such as its portability, capacity of filling contents, productivity of heat sealing at the bottom, stability of connection among multiple tubes arranged in parallel, are well designed, and to provide its manufacturing method.

According to the invention, a multi-tube container arranged in parallel multiple tubes, in each of which a neck portion can be separated by twisting a head portion to create an opening for extruding contents thereof, includes head portions and neck portions, either or both of which are breakably connected with each other at one end of the tubes, and sealing portions formed at the other end of the tubes and breakably connected with each other.

The multiple tubes arranged in parallel are connected with each other at either or both of the head portions and neck portions and further at the sealing portions located at the bottoms of the tubes, so that the entire tubes can be handled easily as a single container. The sealing portions, to which weights of the contents are exerted, are connected with each other, so that the multiple connected tubes can be unitedly constituted under a condition stable as a whole. A content in each tube can be used up after detaching piece by piece.

A manufacturing method for the multi-tube container according to the invention includes the steps of: arranging in parallel, plural thin sleeves for forming body portions of multiple tubes in a cavity of a mold for injection molding; injecting a plastic material into said cavity from one end of said sleeves so as to form on the one end side a heat portion, a neck portion, and a shoulder portion of each tube so that either or both of said head portions and said neck portions are breakably connected; filling contents in the sleeves from the other end of said sleeves; and melting the other end of said tubes so as to form sealing portions for sealing said tubes and so as to breakably connect said one tube with said other adjacent tube or tubes at said sealing portion.

With the manufacturing method for the multi-tube container according to invention, either one or both of the head portions and the neck portions can be breakably connected with each other when those head and neck portions are formed by injection molding, because plural thin sleeves for forming body portions of multiple tubes are arranged in parallel in the cavity of a mold for injection molding and because the plastic material is injected into said cavity from one end of said sleeves so as to form on the one end side a heat portion, a neck portion, and a shoulder portion of each tube. Moreover, with the manufacturing method according to the invention, since the sealing portion at the bottom of the tube is connected to another adjacent sealing portion or other sealing portions, the sealing portions can be connected with each other at the same time when the sealing portions are formed by pressing with heat in order to seal the open end of the sleeves after the contents are filled in the sleeves.

BRIEF DESCRIPTION OF THE DRAWINGS

The above and other objects and features of the invention are apparent to those skilled in the an from the following preferred embodiments thereof when considered in conjunction with the accompanied drawings, in which.

DETAILED DESCRIPTION OF THE PREFERRED EMBODIMENTS

Figure 1:
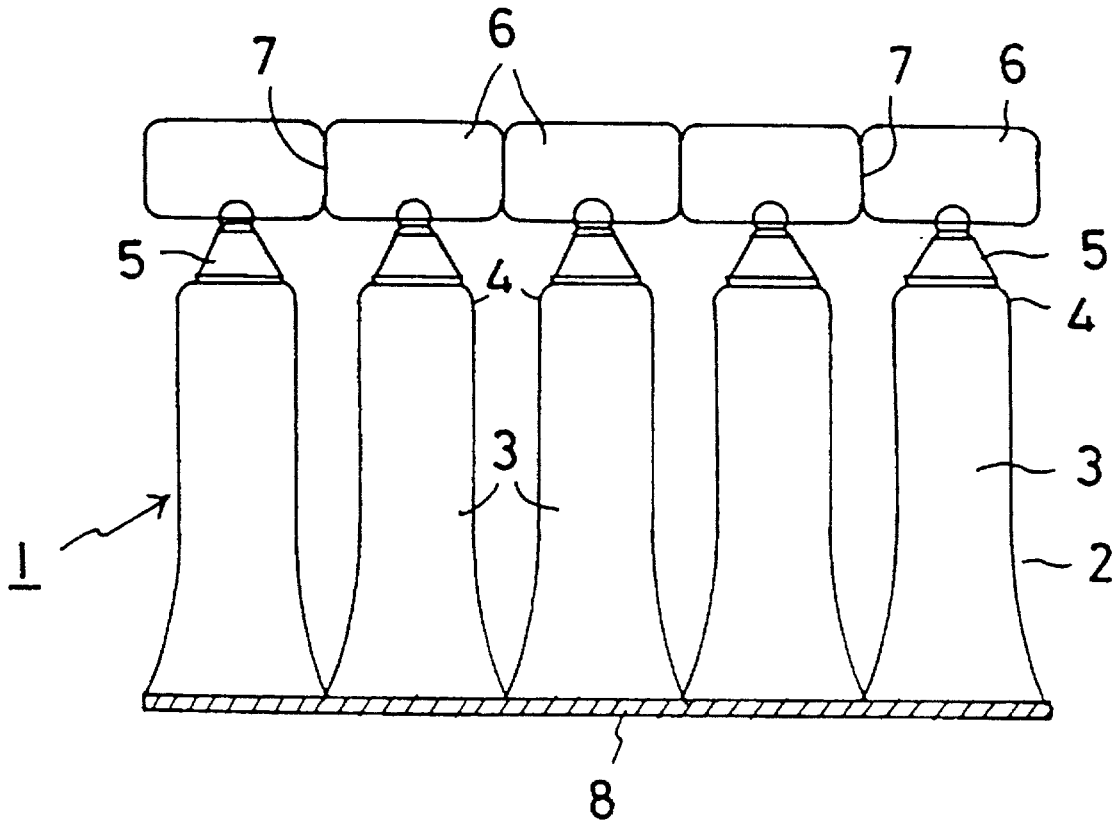
FIG. 1 is an illustration showing a multi-tube container according to the invention.

Referring to the drawings in detail, a multi-tube container and its manufacturing method according to a preferred embodiment of the invention are shown.

In FIG. 1, the reference numeral 1 represents a multi-tube container 1 according to this invention, in which plural squeezable tubes 2 are arranged in a row from one side to the other side. The reference numeral 3 indicates a body portion of the tube 2 and is made of a thin plastic material sleeve or cylinder with thickness of 0.3 mm. A shoulder portion 4, a neck portion 5 whose top is made gradually narrower so as to form a fine opening, and ahead portion 6 flatly and widely projected to the left and right are formed subsequently on the top of the body portion 3. Each head portion 6 is connected to adjacent head portion or portions 6, and a vertical groove 7 for partition is formed between the head portions 6. The reference numeral 8 indicates a heat sealing portion at a bottom of the tube 2. Each heat sealing portion 8 is connected to adjacent heat sealing portion or portions 8 via a thin portion or thin portions to be broken.

Figure 2:
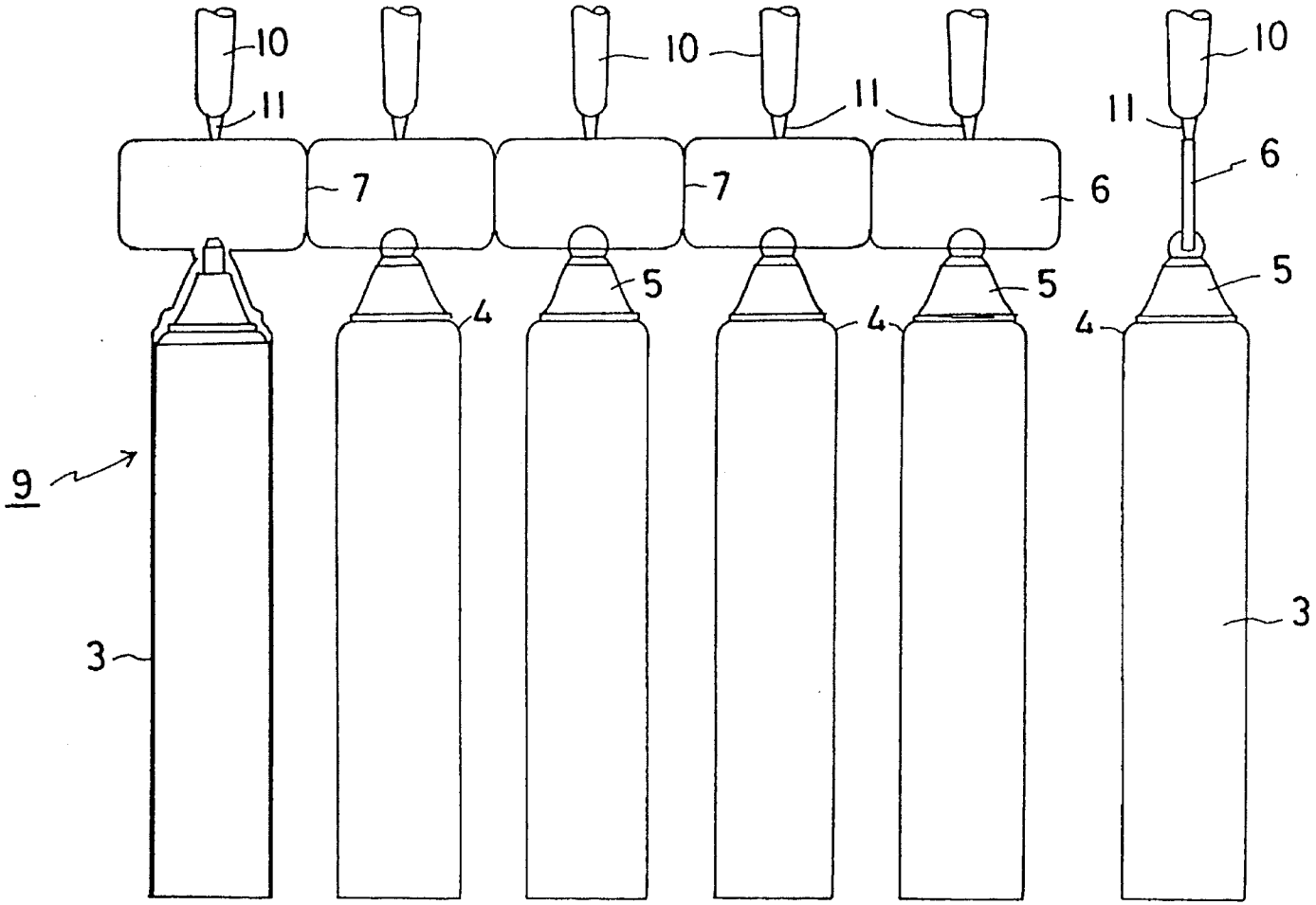
FIGS. 2, 3 are illustrations showing a container during a process for manufacturing the multi-tube container in FIG. 1.
Figure 3:
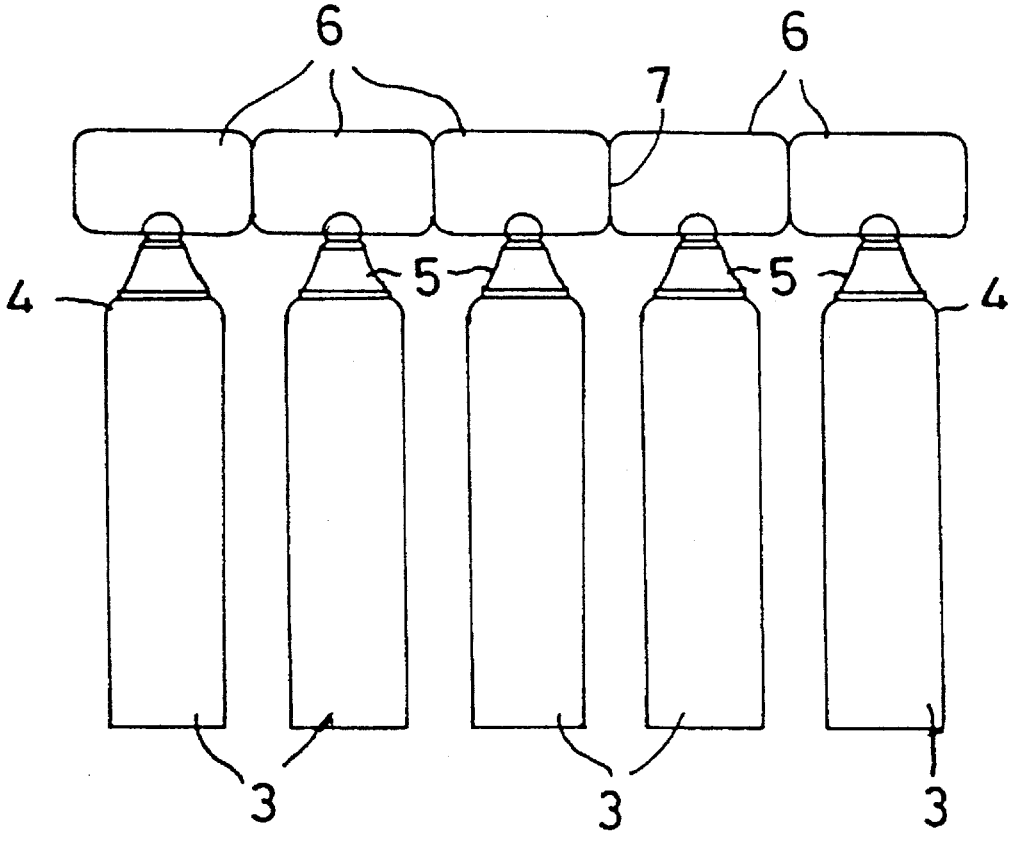

Referring to FIGS. 2, 3, a manufacturing method of the multi-tube container 1 shown in FIG. 1 is described below. In the manufacturing method of the multi-tube container 1 according to the invention, plural body portions 3 made of the thin plastic material sleeves or cylinders with thickness of 0.3 mm, are inserted and arranged in parallel in a cavity of a mold 9 for injection molding. Plastic material is then injected, while the sleeves are set as they are, into the cavity through sprue runners 10 and sprues 11, so that the shoulder portions 4, the neck portions 5 made narrower on theirs upper end so as to constitute fine openings, and the head portions 6 flatly and widely projecting to the left and right are respectively formed.

When forming the head portions 6, molten resin introduced in one compartment of the cavity joins in other molten resin introduced in the adjacent compartment or compartments, because each compartment for forming the head portion 6 has the single sprue 11 for injection molding at the center of the compartment, thereby connecting the head portions 6 in an unstable condition, so that the vertical grooves 7 are automatically formed at the junction portion. The portion at which the vertical groove 7 is formed is made of a junction in such an incomplete state as described above, so that it can be easily broken, thereby easily detaching one head portion 6 from the adjacent head portions 6.

After the contents, such as cosmetics are filled in each tube 2 from the bottom of the body portion 3 of each tube 2, the head portion 6 of which is connected with the adjacent head portion 6 as shown in FIG. 3, the respective bottoms of the body portions 3 are at the same time heated and pressed to form the heat sealing portions 8 by melting and sealing them. The bottom of one body portion 3 is connected to the bottom of the adjacent body portion or portions 3 at the respective heat sealing portions 8, thereby constituting the multi-tube container 1, as shown in FIG. 1, in which the head portions 6 and the heat sealing portions 8 at the bottoms are connected to each other.

The heat sealing portion 8 formed at the bottom of the body portion 3 is flatly pressed at the same time when the bottoms of the body portions 3 adjacent to each other are molten by heat. The connection structure of the heat sealing portion 8 is a structure that the tubes 2 as separated bodies are made to adhere to each other by heat and is different from the structure of the tube's head and neck portions made of the plastic material by injection molding as a united body. That is, since the junction between the heat sealing portions 8 is merely connected by melting of resin's surface, connection of the heat sealing portion is not strong enough and can be separated easily by being torn apart by user's fingers.

Figure 4:
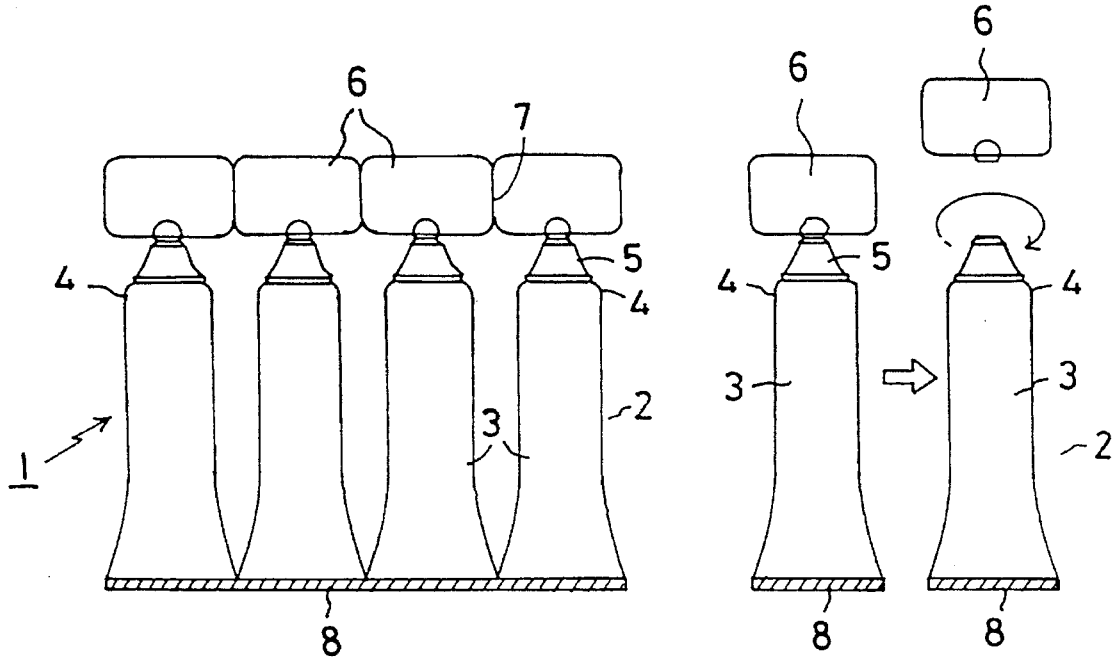
FIG. 4 is an illustration for describing use of the multi-tube container in FIG. 1.

Since the multi-tube container 1 according to the invention has the structure as described above, when using the contents in one of the tubes 2, the head portions 6 of and the heat sealing portions 8 at the bottom of the tubes 2 are respectively torn apart by user's fingers to separate one from the other, as illustrated in FIG. 4. Then the body portion 3 is twisted, while the head portion 6 of the tube 2 is fixed by the fingers, to break off the narrow neck portion 5 located at the top and in continuation with the head portion 6, thereby creating an opening fir extruding the contents at the broken point.

In this embodiment, it is preferable to provide a pitch or intervals between each of the tubes 2 about 1 mm longer than half of the length of the circumference of the body portion 3, so that any overlap of the bottoms of the tubes 2 adjacent to each other when the bottoms are flatly pressed about 1 mm longer than the half length of circumference of the body portion 3 of the By this pitch, the container 1 automatically obtains intervals such that the extended portions of the bottoms of the tubes 2 adjacent to each other are unitedly connected to each other when the bottoms are pressed and extended to the left and right after heated and molten.

(Second Embodiment)

Figure 5B:
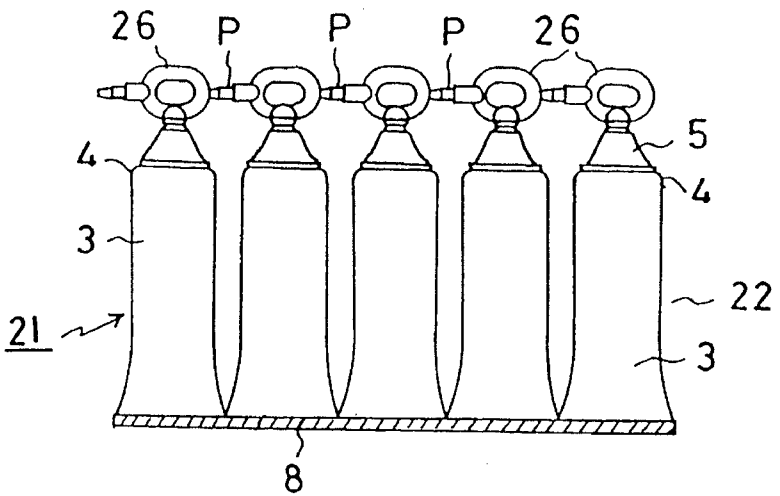
FIGS. 5 (A) to (C) are illustrations showing another multi-tube container according to the second embodiment of the invention.
Figure 5C:
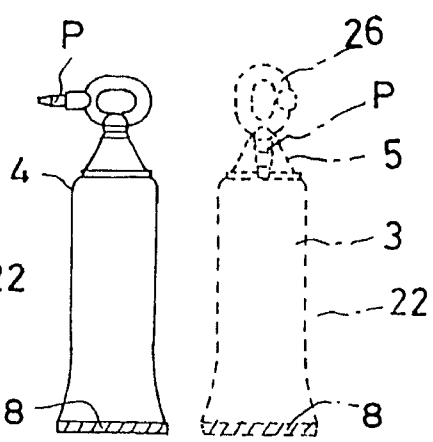
Figure 5A:
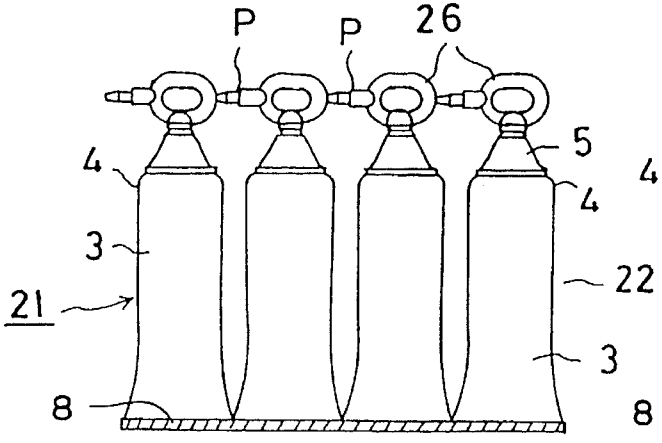
Figure 5A:
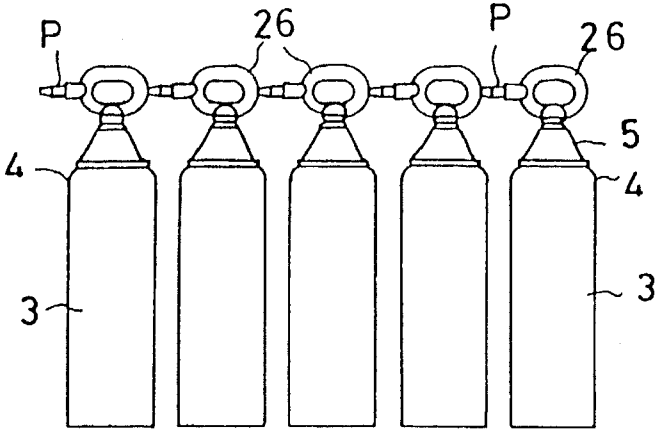

In the above embodiment, the head portion 6 is broken at the neck portion 5 to create the outlet opening. The tubes 22 of a container 21, shown in FIGS. 5(A), (B), (C) are constituted such that their head portions 6 are connected with pins P in a chain like shape. As apparent from FIG. 5(C), after an opening had been created by twisting the head portion 26, the pin P firmed at the head portion 26 is inserted into the opening to plug up it temporarily. In this second embodiment, the contents need not be used up after the opening is made, and only a small amount of the contents can be used at a time.

(Third Embodiment)

Figure 6:
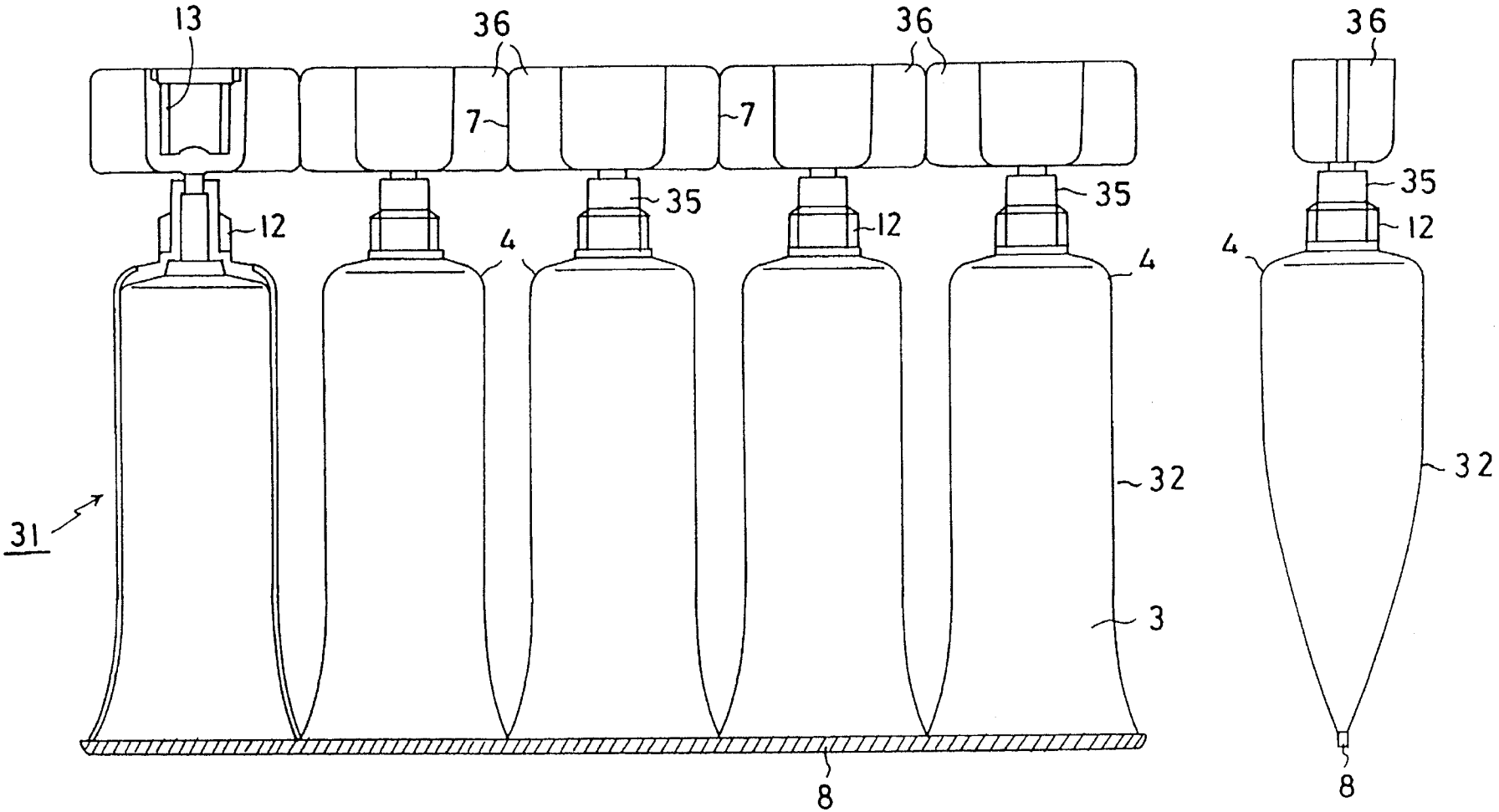
FIG. 6 is an illustration showing another multi-tube container according to the third embodiment of the invention.

In tubes 32 of a multi-tube container 31 shown in FIG. 6, a male screw 12 is formed at a circumference of the neck portion 35, and a female screw 13 capable of engaging with the male screw 12 is formed at an inner circumference in a recess located at a top center of the head portion 36. In this modification, after the head portion 36 has been broken off to create the opening, the head portion 36 is turned upside down so that the head portion 36 can be used as a cap to engage with the neck portion 35.

(Fourth Embodiment)

Figure 7B:
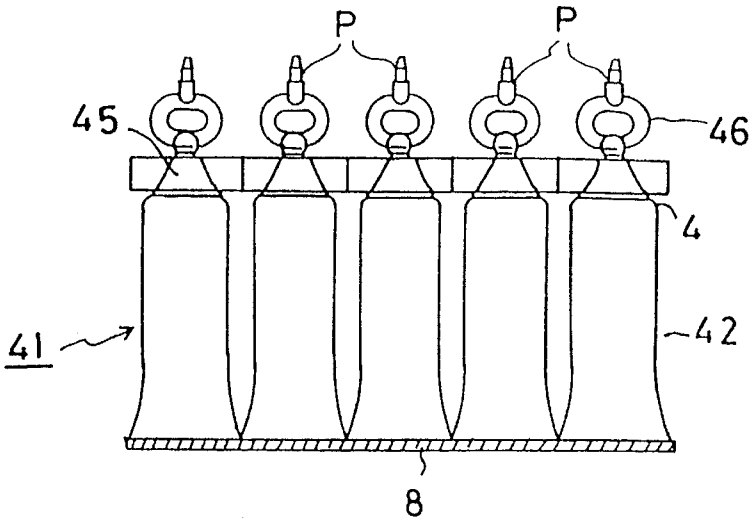
FIGS. 7 (A) to (C) are illustrations showing another multi-tube container according to the fourth embodiment of the invention.
Figure 7C:
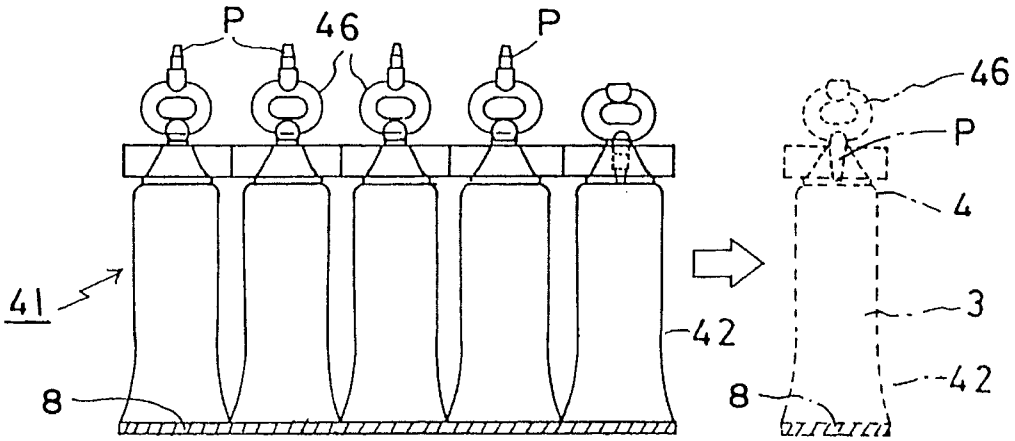
Figure 7A:
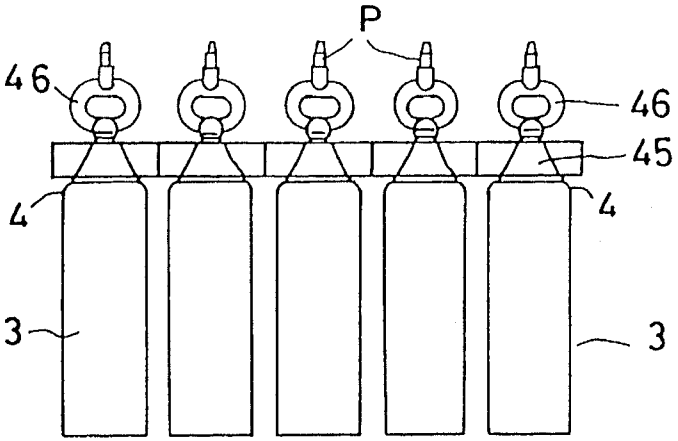

FIGS. 7(A), (B), (C) are schematic diagrams of a fourth embodiment of a multi-tube container 41 in which each tube 42 is connected at its neck portion 45 and its heat sealing portion 8 at the bottom. With this embodiment, pins P formed at the head portions 46 are constituted, as different from one shown in FIGS. 5 (A) to (C), so as to project upward therefrom. The pin P can be inserted into the opening and to plug up the opening temporarily.

(Fifth Embodiment)

Figure 8B:
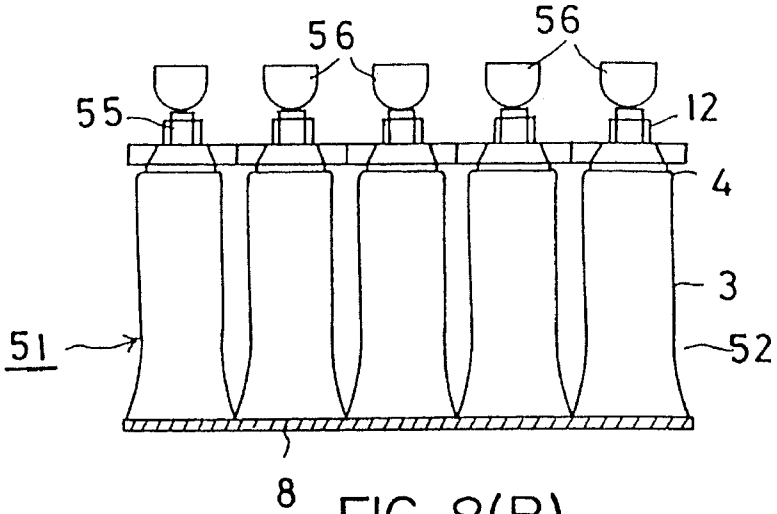
FIGS. 8 (A) to (C) are illustrations showing another multi-tube container according to the fifth embodiment of the invention.
Figure 8C:
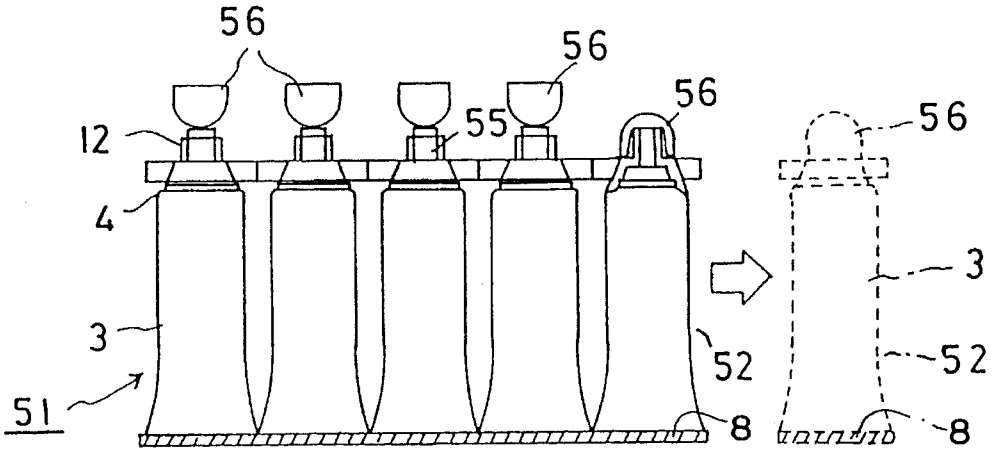
Figure 8A:
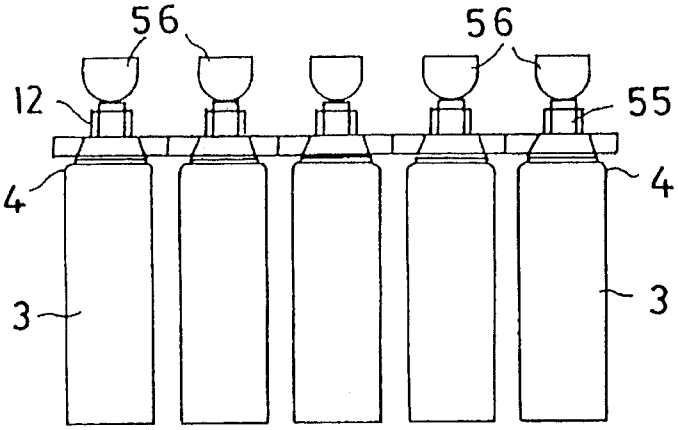

FIGS. 8(A), (B), (C) show a structure that the tubes 52 are connected at their neck portion 55 and heat sealing portions 8 at the bottoms of the body portion 3. In this multi-tube container 51 according to the fifth embodiment, the head portion 56 constitutes a screw cap, and therefore, the cap type head portion 56 can engage with a male screw 12 formed at the neck portion 55, thereby plugging up the opening temporarily.

(Sixth Embodiment)

Figure 9A:
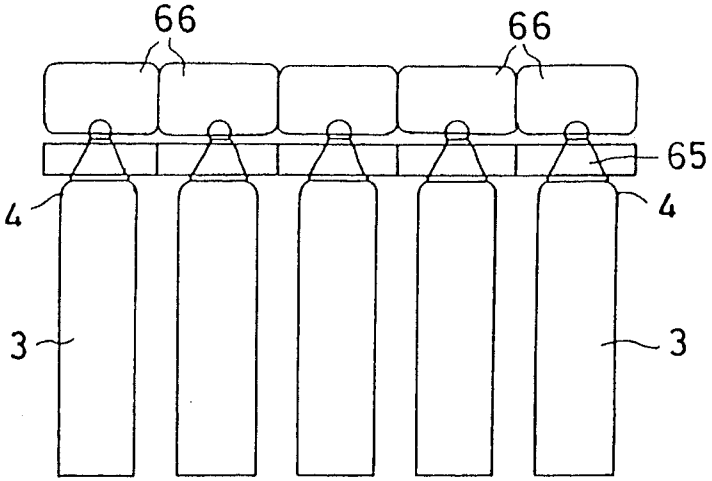
FIGS. 9 (A) to (C) are illustrations showing another multi-tube container according to the sixth embodiment of the invention.
Figure 9B:
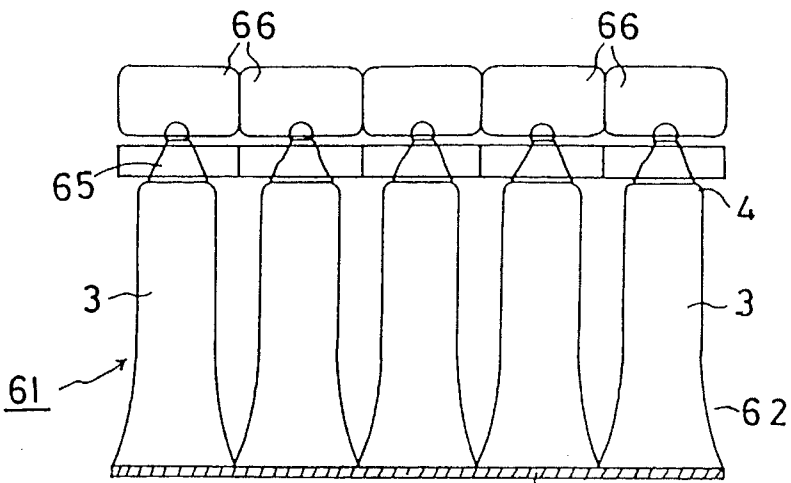
Figure 9C:
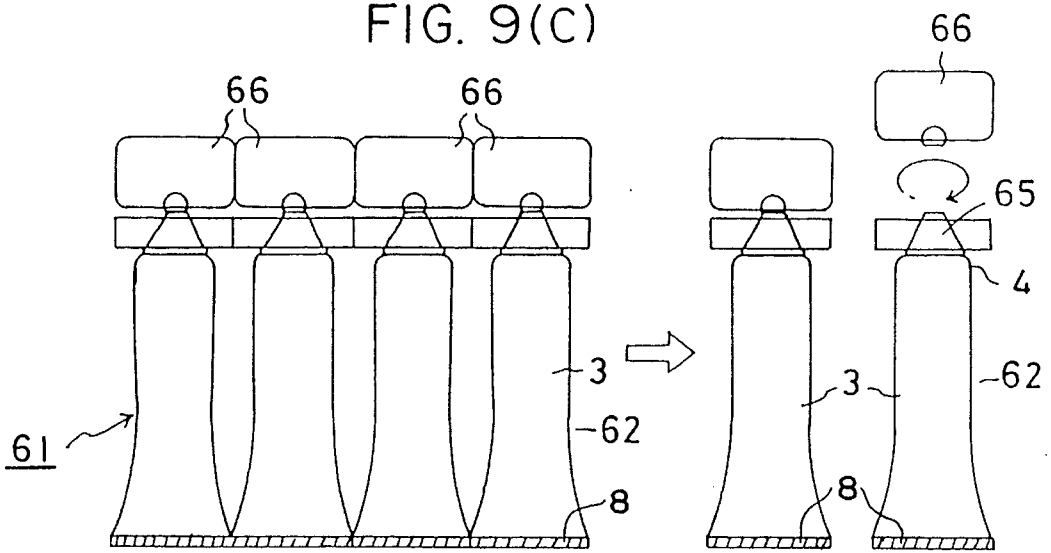

A sixth embodiment shown in FIGS. 9(A), (B), (C) is a further improved multi-tube container 1 in comparison with the container 61 shown in FIG. 1. In this embodiment, the tubes 62 are connected with each other at their head portions 66, at the bottoms of the body portions 3, and further at their neck portions 65, so that the connection among the tubes 62 are strengthened.

The multi-tube container, as well as its manufacturing method, has the following advantages because it has the constitution and operation as described above. The multiple tubes can be connected at either or both of the head portions and the neck portions, and further at the bottoms. In particular, sealing work and the connection work of the bottoms can be done together, since the respective tubes are connected at the heat sealing portions at the bottoms. Since the bottoms are connected in addition to the tops, the entire structure of the multi-tube container becomes united and stable. Each tube can be easily detached from others and be disposable respectively. In particular, the vertical groove can be formed at the connection of the tops of the respective tubes, so that cutting for detaching of the tube can be done easily at the vertical groove. Inserting plastic material sleeves or cylinders in the cavity of the mold for injection molding and arranging them in parallel allows to form the shoulder, neck, and head portions of the tubes and, at the same time, to connect the tops of the tubes with each other. Therefore, the container can be inexpensively produced in a large amount.

It is understood that although the present invention has been described in detail with respect to preferred embodiments thereof, various other embodiments and variations are possible to those skilled in the art which fall within the scope and spirit of the invention, and such other embodiments and variations are intended to be covered by the following claims.

What is claimed is:

1. A multi-tube container having multiple tubes in parallel, said container comprising:

a plurality of body portions, each having a hollow portion for containing contents, said body portions being separated from one another without having connections therebetween;

a plurality of twistable head portions formed at one end of each of said body portions;

a plurality of neck portions creating an opening for extruding the contents from said hollow portion when one of said plurality of twistable head portions is broken off from one of said plurality of body portions, said plurality of neck portions being located between said body portion and said head portion; and a plurality of sealing portions formed at the other end each of said body portions, each of said plurality of sealing portions breakably connected to at least one adjacent sealing portion by heat-pressing the other end of said one of said body portions with the other end of an adjacent body portion, wherein at least one of said head portions and said neck portions are breakably connected to each other.

2. The multi-tube container as set forth in claim 1, wherein sad at least one of said head portions and said neck portions have partition grooves, respectively, to separate one tube from the other.

3. The multi-tube container as set forth in claim 1, wherein a cap portion for plugging said neck portion is formed at a part of said head portion.

4. The multi-tube container as set forth in claim 1, wherein a pin portion for plugging said neck portion is formed at a part of said head portion.

5. A multi-tube container, comprising:

a first tube;

a second tube being separated from said first tube by a predetermined distance without having connections therebetween;

a first head formed at a first end of said first tube;

a second head portion formed at a second end of said second tube, said second head portion being detachably connected to said first head portion;

a first bottom portion formed at a third end of said first tube, said first bottom portion sealing said first tube; and a second bottom portion formed at a fourth end of said second tube, said second bottom portion sealing said second tube and being detachably connected to said first bottom portion.

6. A multi-tube container of claim 5, wherein said first head portion includes at least a first detachable head portion and a first neck portion connecting said first detachable head portion to said first tube, and said second head portion includes at least a second detachable head portion and a second neck portion connecting said second detachable head portion to said second tube.

7. A multi-tube container of claim 6, wherein said second detachable head portion is detachably connected to said first detachable head portion.

8. A multi-tube container of claim 6, wherein said second neck portion is detachably connected to said first neck portion.

9. A multi-tube container of claim 5, wherein said second bottom portion is detachably connected to said first bottom portion by press-heating said third and fourth ends together.

10. A multi-tube container of claim 9, wherein said predetermined distance is determined based on a width of said third and fourth ends when said third and fourth ends are being pressed.

11. A multi-tube container of claim 9, wherein said predetermined distance is a distance between said first and second tubes when said third end contacts with said fourth end at the time said third and fourth ends are being pressed.

* * * * *